US009752359B2

(12) United States Patent
Ali et al.

(10) Patent No.: US 9,752,359 B2
(45) Date of Patent: Sep. 5, 2017

(54) LOCK MECHANISM WITH EGRESS RELEASE

(71) Applicant: Schlage Lock Company LLC, Indianapolis (IN)

(72) Inventors: Mohammed Maksood Ali, Bangalore (IN); Rohith Badhya, Bangalore (IN); Sajil John Mathachan, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 276 days.

(21) Appl. No.: 14/728,287

(22) Filed: Jun. 2, 2015

(65) Prior Publication Data

US 2015/0345175 A1 Dec. 3, 2015

Related U.S. Application Data

(60) Provisional application No. 62/006,742, filed on Jun. 2, 2014.

(51) Int. Cl.

| | |
|---|---|
| ***E05B 13/10*** | (2006.01) |
| ***E05C 1/16*** | (2006.01) |
| ***E05B 17/00*** | (2006.01) |

(52) U.S. Cl.

CPC ..... *E05C 1/163* (2013.01); *E05B 13/108* (2013.01); *E05B 17/005* (2013.01); *Y10T 292/93* (2015.04)

(58) Field of Classification Search

CPC .... E05B 13/004; E05B 13/108; E05B 17/005; E05C 1/163; Y10T 292/93; Y10T 292/96

USPC ..... 70/149, 210, 215–218, 221–224, 70/467–489, DIG. 3; 292/169.15–169.17, 292/169.21–169.23, 336.3, 336.5, 347, 292/358, 359, DIG. 27, DIG. 52

See application file for complete search history.

(56) References Cited

U.S. PATENT DOCUMENTS

| | | | | |
|---|---|---|---|---|
| 4,470,278 | A | 9/1984 | Hale et al. | |
| 5,784,909 | A | 7/1998 | Huang | |
| 6,216,500 | B1 | 4/2001 | Kang | |
| 6,807,833 | B1 | 10/2004 | Huang et al. | |
| 6,993,945 | B1 | 2/2006 | Chen | |
| 7,100,407 | B2 | 9/2006 | Chen | |
| 7,559,219 | B2 | 7/2009 | Chen | |
| 7,934,754 | B2 | 5/2011 | Mathachan | |
| 8,491,023 | B2 | 7/2013 | Brannaman et al. | |
| 8,833,120 | B2 * | 9/2014 | Collins | E05B 55/005 292/336.3 |
| 9,611,672 | B2 * | 4/2017 | Murphy | E05B 55/005 |
| 2009/0056392 | A1 * | 3/2009 | Brannaman | E05B 17/005 70/91 |
| 2013/0233033 | A1 | 9/2013 | Collins et al. | |
| 2014/0007630 | A1 | 1/2014 | Brannaman et al. | |

(Continued)

*Primary Examiner* — Lloyd Gall

(74) *Attorney, Agent, or Firm* — Taft Stettinius & Hollister LLP

(57) ABSTRACT

An exemplary locking system includes an outer actuator, an outer spindle coupled to the outer actuator, a center spindle coupled to a latch assembly, and a lock control assembly selectively coupling the outer spindle and the center spindle. The lock control assembly is operable in a locked state wherein rotation of the manual actuator is prevented, and an unlocked state wherein the manual actuator is operable to rotate the center spindle. The lock control assembly is configured to transition from the locked state to the unlocked state in response to rotation of the center spindle, for example by an inner actuator.

18 Claims, 6 Drawing Sheets

(56) References Cited

U.S. PATENT DOCUMENTS

| | | | | |
|---|---|---|---|---|
| 2014/0191516 | A1* | 7/2014 | Badhya | E05B 13/004 292/145 |
| 2015/0013402 | A1* | 1/2015 | Murphy | E05B 55/005 70/141 |

* cited by examiner

LOCK MECHANISM WITH EGRESS RELEASE

TECHNICAL FIELD

The present disclosure generally relates to door locks, and more particularly, but not exclusively, to door locks which allow for egress when the unit is locked.

BACKGROUND

Locking assemblies commonly include an outer handle on the unsecured or outer side of a door, and an inner handle on the secured or inner side of the door. In many such assemblies, the inner handle remains unlocked at all times such that the door can always be opened from the secured side, for example to allow for emergency egress. In certain assemblies of this type, operating the inner handle while the assembly is locked does not unlock the assembly. As such, if the user exits the secured area and closes the door, the user will be unable to reopen the door without having the proper key. While such a feature is desirable in certain applications such as office buildings and schools, it may be less desirable in other applications. For example, a residential user may prefer that the door remains unlocked after being opened from the inside, in order to prevent the user from being inadvertently locked out of their home. Therefore, a need remains for further improvements in this technological field.

SUMMARY

An exemplary locking system includes an outer actuator, an outer spindle coupled to the outer actuator, a center spindle coupled to a latch assembly, and a lock control assembly selectively coupling the outer spindle and the center spindle. The lock control assembly is operable in a locked state wherein rotation of the manual actuator is prevented, and an unlocked state wherein the manual actuator is operable to rotate the center spindle. The lock control assembly is configured to transition from the locked state to the unlocked state in response to rotation of the center spindle, for example by an inner actuator.

DETAILED DESCRIPTION

Figure 1:
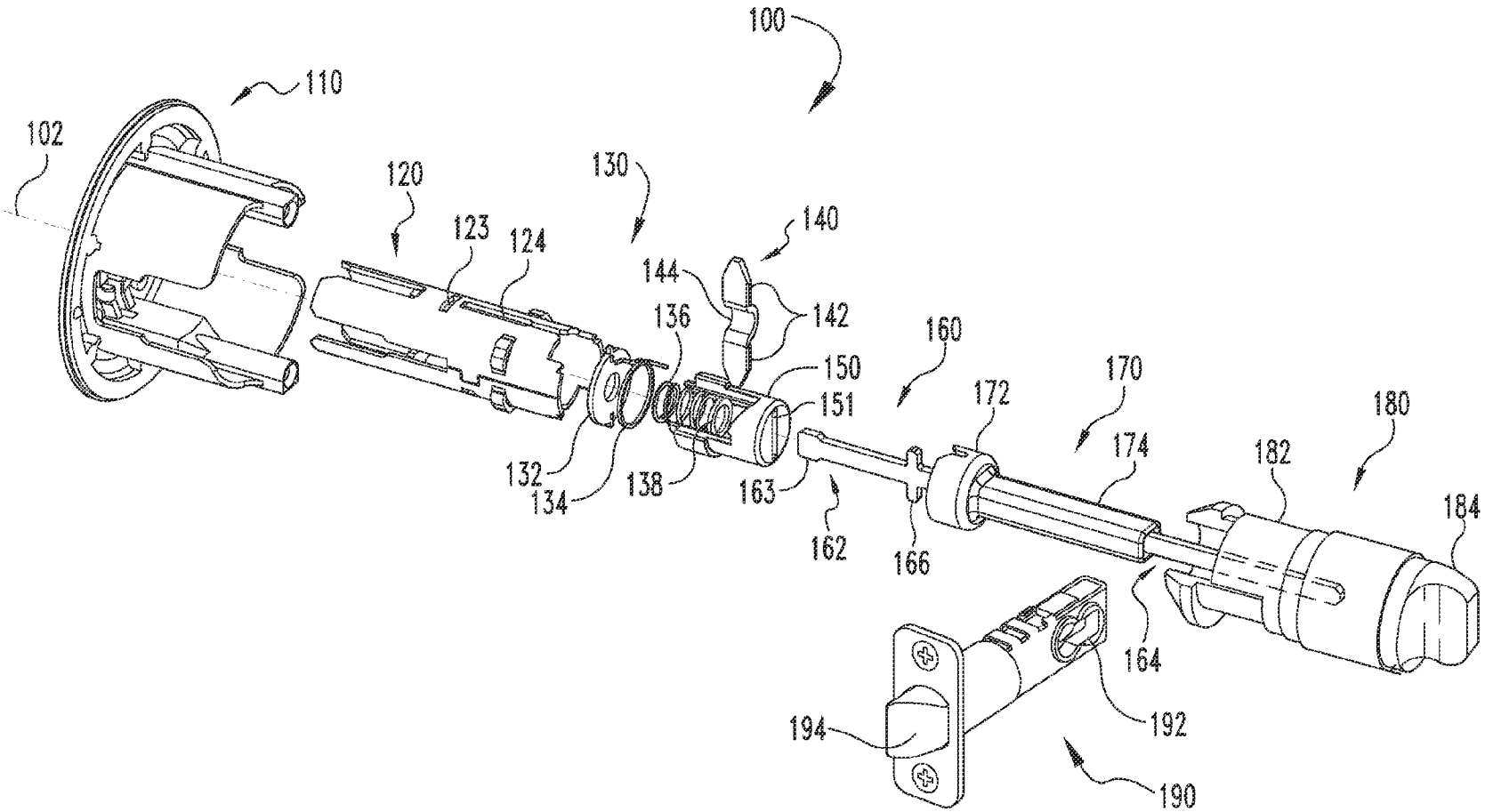
FIG. 1 is an exploded perspective view of a portion of a lock system according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, an illustrative locking system 100 includes a housing 110, an outer spindle 120, a lock control assembly 130 including a locking slide 140 and a cam 150, a plunger bar 160 extending through a center spindle 170, a turn piece 180 coupled to the plunger bar 160, and a latch assembly 190. The latch assembly 190 includes a retractor 192 coupled to the center spindle 170, and a latch bolt 194 configured to extend or retract in response to rotation of the retractor 192. The housing 110 may be configured for installation on an unsecured or outer side of a door, and the outer spindle 120 may be coupled to a manual actuator installed on the outer side of the door. Additionally, the center spindle 170 may be coupled to a second manual actuator installed on the secured or inner side of the door, for example through an inner spindle, and the turn piece 180 may be mounted on the inner actuator.

As used herein, the terms "proximal" and "distal" indicate opposite directions along a longitudinal axis 102 of the system 100. While other forms are contemplated, in the illustrated embodiment, the proximal direction is toward the unsecured side of the system 100, and the distal direction is toward the secured side of the system 100. Thus, when the exemplary system 100 is assembled and installed on a door, the proximal side of an element is closer to the unsecured or outer side of the door, and the distal side of the element is closer to the secured or inner side of the door. Additionally, motion or spacing along one direction need not preclude motion or spacing along another of the directions. The terms are therefore not to be construed as limiting the scope of the subject matter described herein.

The lock control assembly 130 further includes a spring anchor 132, a rotational biasing member such as a torsion spring 134, and an axial biasing member such as a compression spring 136. When assembled, the spring anchor 132 may be coupled to the outer spindle 120 (for example by radial tabs 133 extending into openings 123 in the spindle), such that the spring anchor 132 provides an anchor point for the proximal ends of the springs 134, 136. One end of the torsion spring 134 may be coupled to the spring anchor 132, and the other end may be coupled to the cam 150, such that the torsion spring 134 rotationally biases the cam 150 toward an unlocking orientation (described in further detail below). The compression spring 136 may be positioned between the spring anchor 132 and a washer 138, such that the compression spring 136 biases the washer 138 in the distal direction.

Figure 2:
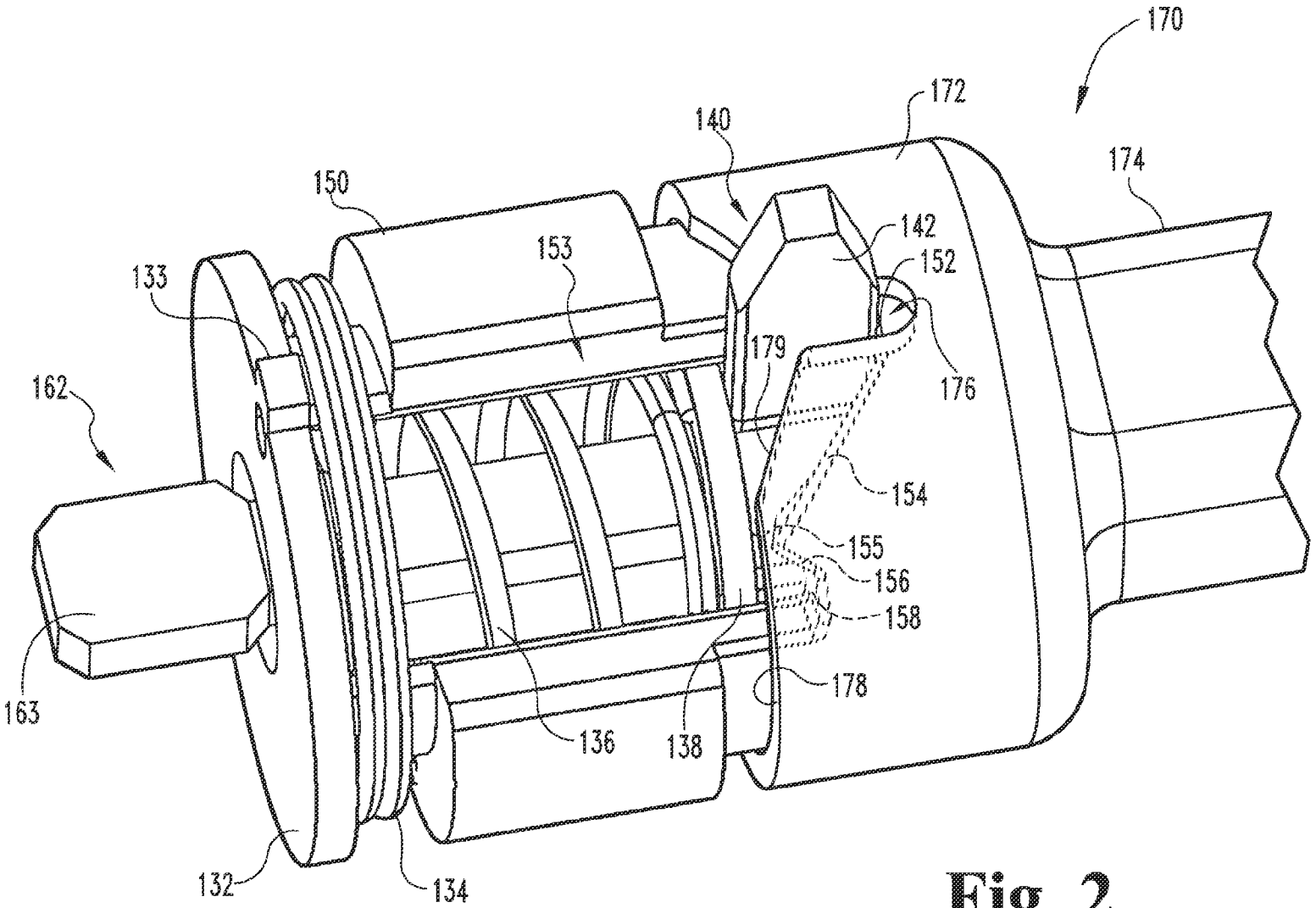
FIG. 2 is a perspective view of an illustrative lock control assembly usable in the lock system depicted in FIG. 1.
Figure 3:
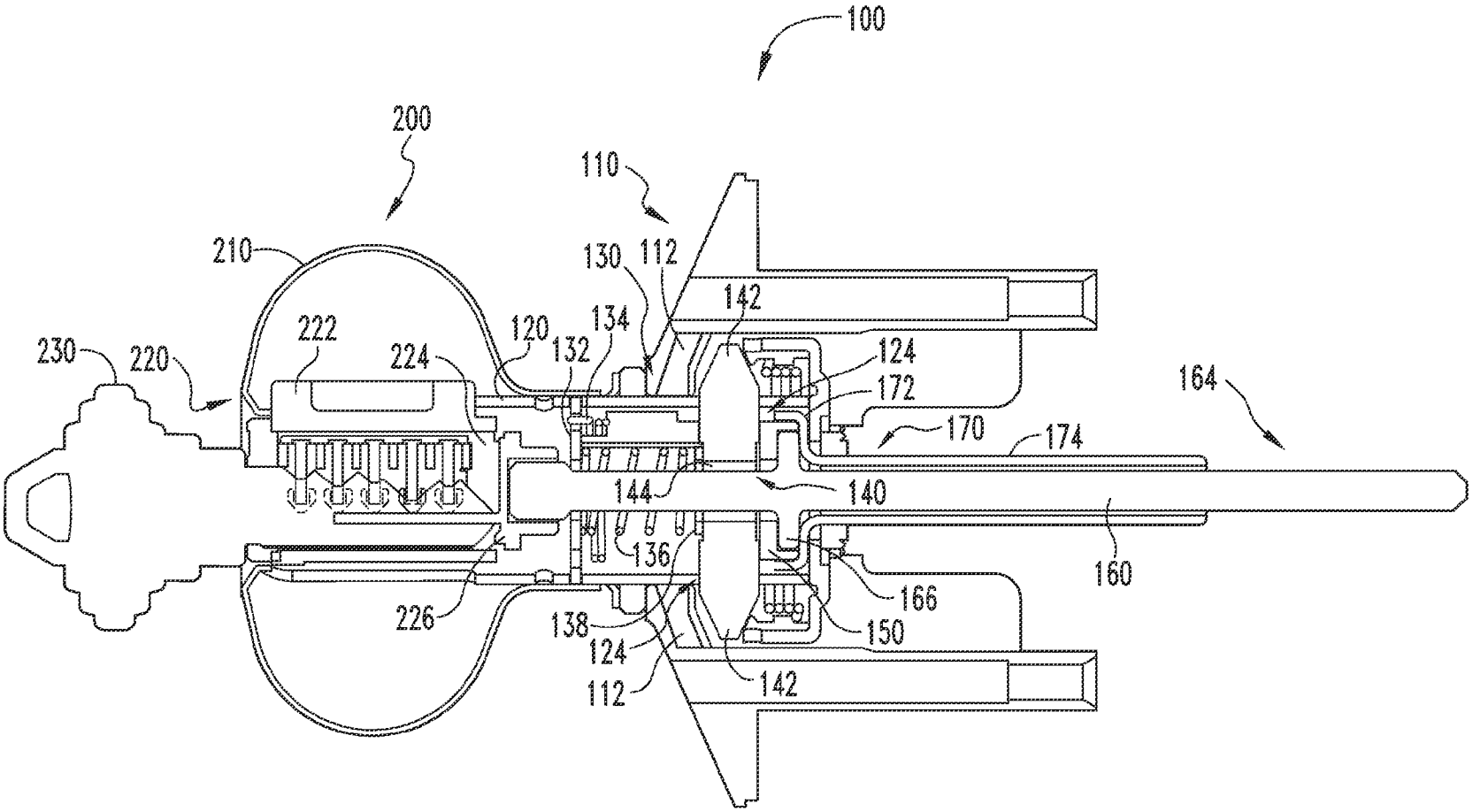
FIG. 3 is a cross-sectional view of the lock system depicted in FIG. 1 along with an actuator assembly.

The locking slide 140 includes a pair of arms 142 connected by a central curved portion 144. As illustrated in FIGS. 2 and 3, when the system 100 is assembled, the curved portion 144 is positioned adjacent the plunger bar 160, and the arms 142 extend radially out of the cam 150. As described in further detail below, locking and unlocking of the system 100 is achieved by selective engagement of the locking slide 140 with the housing 110 and the center spindle 170.

The plunger bar 160 includes a proximal end 162 including a head 163, a distal end 164 engaged with the turn piece 180, and a crossbar 166. Thus, when the system 100 is assembled and installed on a door (not illustrated), the proximal end 162 is closer to the unsecured side of the door, and the distal end 164 is closer to the secured side of the door. Additionally, the crossbar 166 is positioned in a slot 151 formed in the cam 150, such that the cam 150 is rotationally coupled to the plunger bar 160.

The center spindle 170 has a proximal side including a substantially cylindrical cup 172, and a stem 174 extending distally from the cup 172. When assembled, the cam 150 is seated or received in the cup 172, and the plunger bar 160 extends through the stem 174. The stem 174 is configured to be coupled to the retractor 192, such that rotation of the center spindle 170 causes the latch bolt 194 to extend or retract. The outer profile of the stem 174 may have a first predetermined geometry, and the inner profile of the retractor 192 may have a corresponding geometry to matingly engage the stem 174. While other forms are contemplated, in the illustrated embodiment, the stem 174 has a substantially square-shaped outer profile, and the retractor 192 has a corresponding inner profile.

The turn piece 180 includes a bracket 182 coupled to the plunger bar distal end 164, and a thumb turn 184 coupled to the bracket 182. As noted above, when assembled, the turn piece 180 may be installed on the inner actuator, such that the thumb turn 184 is accessible from the secured side of the door. A user can manually lock and unlock the system 100 from the secured side of the door by rotating the turn piece 180, thereby rotating the plunger bar 160. In other embodiments, the turn piece 180 may be replaced by a push button with a cam surface operable to rotate the plunger bar 160 when the push button is depressed.

With additional reference to FIG. 2, the cam 150 is substantially cylindrical, and is configured to be received in the cup 172. The cam 150 includes an opening 153 defined in part by a distal edge 152 or distal landing, a primary ramp 154 which extends in the proximal direction from the distal edge 152 to a peak or vertex 155, and a secondary ramp 156 which extends in the distal direction from the vertex 155 to a ledge 158 or proximal landing. In other words, the primary ramp 154 extends in a first rotational direction and the distal direction from the vertex 155 to a first terminus which connects the primary ramp 154 to the distal edge 152 or distal landing. Similarly, the secondary ramp 156 extends in a second rotational direction and the distal direction from the vertex 155 to a second terminus which connects the secondary ramp 156 to the ledge 158 or proximal landing. For reasons which will become apparent, the ledge 148 is axially positioned on the proximal side of the distal edge 152. Additionally, the cup 172 includes slots 176 (only one visible in FIG. 2) configured to receive the locking slide arms 142, a proximal end surface 178, and a pair of chamfers 179 extending from each slot 176 toward the proximal end surface 178.

When the lock control assembly 130 is assembled, the torsion spring 134 couples the spring anchor 132 and the cam 150, and the compression spring 136 is positioned between the washer 138 and the spring anchor 132 as described above. The locking slide 140 is positioned in the opening 153 on the distal side of the washer 138, such that the compression spring 136 biases the slide 140 in the distal direction. The cam 150 is received in the cup 172, and the plunger bar 160 extends through the lock control assembly 130 and the center spindle 170, such that the head 163 is positioned on the proximal side of the spring anchor 132, and the distal end 164 extends out of the stem 174. Additionally, the curved central portion 144 of the locking slide 140 is positioned adjacent the plunger bar 160, such that the plunger bar 160 is free to rotate within the opening defined by the curved portion 144.

With additional reference to FIG. 3, the locking system 100 may further include an outer actuator assembly 200 and an inner actuator assembly. The exemplary outer actuator assembly 200 includes a manual actuator such as a knob 210, and a lock cylinder 220 operable by a key 230. The knob 210 is rotationally coupled to the outer spindle 120, which extends into the housing 110. A distal end of the outer spindle 120 may be coupled to a spring cage 212, such that the knob 210 is biased to a home position. Additionally, the lock control assembly 130 is positioned at least partially in the outer spindle 120 between the knob 210 and the spring cage 212. As described above, the spring anchor 132 is rotationally coupled to the outer spindle 120, thereby providing an anchor point for the springs 134, 136.

The lock cylinder 220 may be a conventional lock cylinder of the type including a shell 222, a plug 224, and a key cam 226 coupled to the plug 224. As is known in the art, insertion of the proper key 230 enables rotation of the plug 224 with respect to the shell 222. The key cam 226 is coupled to the head 163 (for example via a lost motion connection such as a bowtie opening), such that rotation of the plug 224 through a predetermined angle causes rotation of the plunger bar 160.

As depicted in FIG. 3, when assembled, the locking slide arms 142 extend radially outward through slots 124 formed in the spindle 120. The housing 110 includes a pair of slots 112 configured to receive the locking slide arms 142. In an unlocked state (FIG. 3), the slide 140 is in an unlocking position, wherein the arms 142 are not received in the slots 112, and are instead received in the center spindle slots 176. Interference between the spindle 120, the locking slide 140, and the center spindle 170 rotationally couples the outer spindle 120 to the center spindle, such that the outer knob 210 is operable to rotate the center spindle 170 to retract the latchbolt 194. In a locked state (FIG. 5), the locking slide 140 is in a locking position, wherein the arms 142 are received in the slots 112. Interference between the housing 110, the spindle 120, and the locking slide 140 rotationally couples the spindle 120 to the housing 110, preventing rotation of the outer knob 210. This form of locking by selective engagement between a locking slide and a housing is known in the art (see, for example, U.S. Pat. No. 4,470,278 to Hale), and need not be further described herein.

FIGS. 2 and 3 depict the lock control assembly 130 in an unlocked state, wherein each of the locking slide 140 and the cam 150 is in an unlocking position. As noted above, in the unlocking position, the arms 142 are received in the center spindle slots 176. In the illustrated form, the arms 142 are also urged in contact with the distal edge 152 by the compression spring 136, although it is also contemplated that the compression spring 136 may urge the arms 142 into contact with the distal end surfaces of the slots 176. In order to unlock the system 100, the user may rotate the plunger bar 160, for example by rotating the turn piece 180 or the lock plug 224. As the plunger bar 160 rotates the cam 150 in the unlocking direction, the locking slide 140 is urged in the proximal direction as the arms 142 travel along the primary ramps 154 and into contact with the vertices 155. Continued rotation of the cam 150 causes the compression spring 136 to urge the locking slide 140 in the distal direction as the arms 142 travel along the secondary ramp 156 and into contact with the ledges 158, at which point the locking slide 140 is in the locking position.

Figure 4:
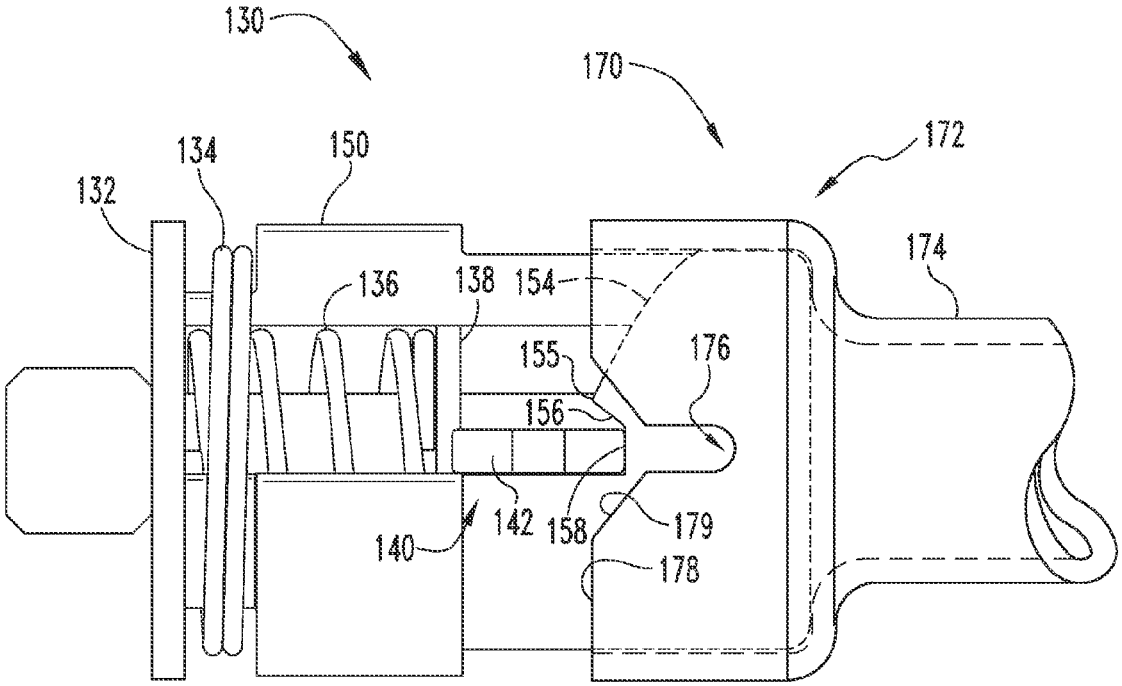
FIG. 4 is an elevational view of the illustrative lock control assembly in a locked state.
Figure 5:
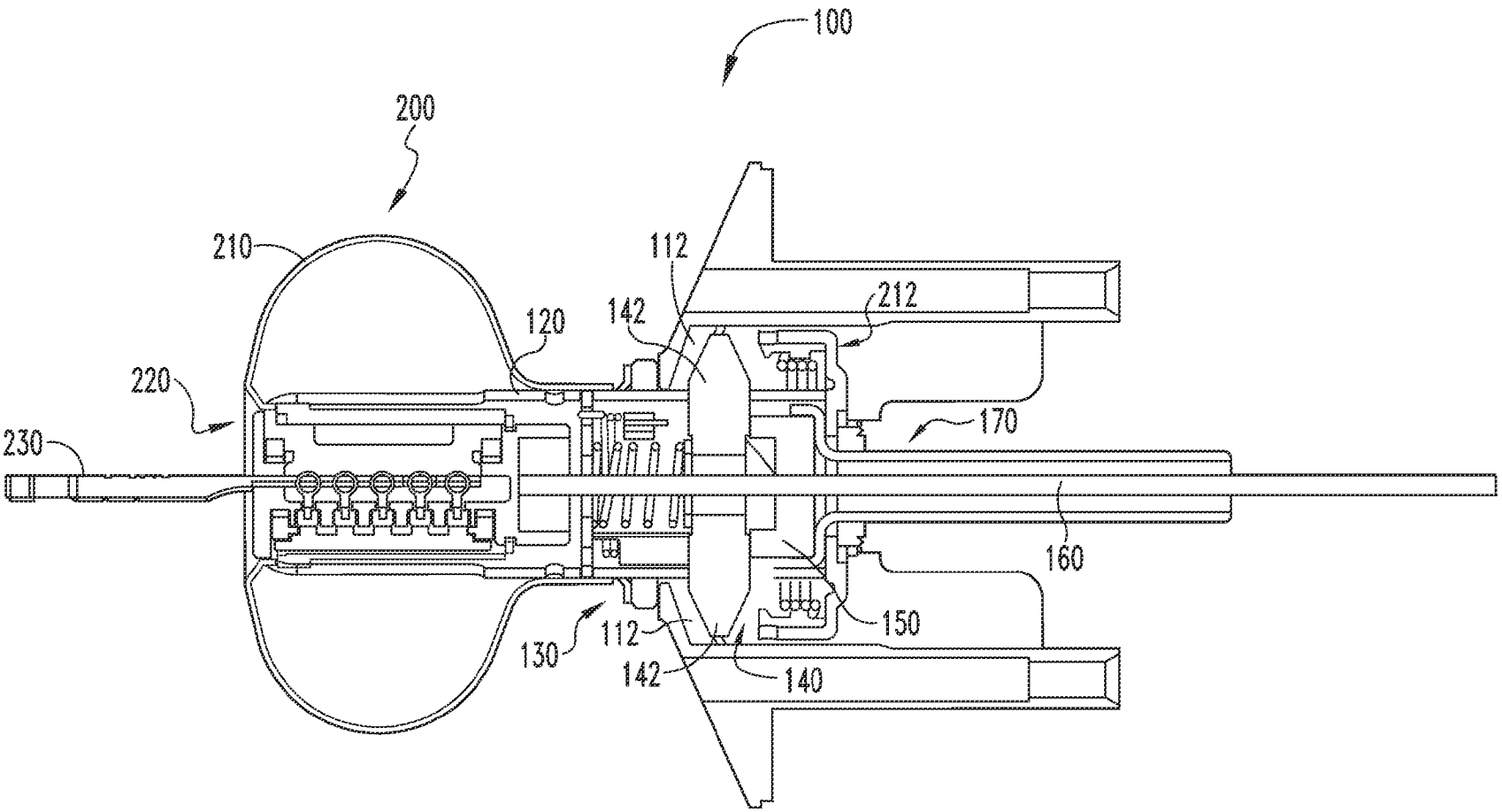
FIG. 5 is a cross-sectional illustration of the lock system depicted in FIG. 3 in a locked state.

FIGS. 4 and 5 depict the lock control assembly 130 in a locked state, wherein each of the locking slide 140 and the cam 150 is in a locking position. In the locked state, the locking slide arms 142 are urged into contact with the secondary ramps 156 and the ledges 158, due to the biasing forces of the torsion spring 134 and the compression spring 136, respectively. Additionally, the arms 142 are aligned with the center spindle slots 176 (FIG. 4), and are received in the housing slots 112 (FIG. 5). Due to the fact that the arms 142 are not positioned in the center spindle slots 176, the center spindle 170 is rotationally decoupled from the outer spindle 120. As a result, the center spindle 170 can be rotated (for example by the inner actuator) to retract the latch bolt 194, despite the fact that the outer spindle 120 is rotationally coupled to the housing 110.

In the locked state, rotation of the plunger bar 160 in an unlocking direction (for example in response to rotation of the plug 224 or the turn piece 180) causes the cam 150 to rotate in the unlocking direction. As the cam 150 rotates, the secondary ramp 156 urges the locking slide 140 in the proximal direction against the biasing force of the compression spring 136. As the cam 150 continues to rotate, the slide 140 comes into contact with the primary ramp 154, and the compression spring 136 urges the slide 140 in the distal direction. As the slide 140 moves in the distal direction, the arms 142 move out of the housing slots 112 and enter the center spindle slots 176 (see FIG. 7). As a result, the outer spindle 120 is no longer rotationally coupled to the housing 110, and is instead rotationally coupled to the center spindle 170. The system 100 is thus in an unlocked state, as the knob 210 can be rotated to rotate the center spindle 170 and retract the latch bolt 194.

In order to prevent lockouts, the exemplary locking system 100 is also configured to transition from the locked state to the unlocked state when operated from the secured side (e.g. by the inner actuator). With specific reference to FIGS. 3-7, further details regarding such automatic unlocking will now be provided. In the locked state (FIG. 4), the ledge 158 is substantially aligned with the distal end of the chamfers 179 such that the distal ends of the arms 142 are aligned with the chamfers 179. When the center spindle 170 is rotated (for example by rotation of the inner actuator), the chamfers 179 engage the arms 142, urging the locking slide 140 in the proximal direction. As the center spindle 170 rotates, the chamfers 179 urge the locking slide arms 142 in the proximal direction, and into contact with the proximal end surface 178 (FIG. 5). In the illustrated form, the distal end of the chamfers 179 are positioned on the distal side of the ledge 158, in order to ensure that upon rotation of the center spindle 170, the arms 142 engage the chamfers 179, and do not become trapped in the slot 176.

Figure 6:
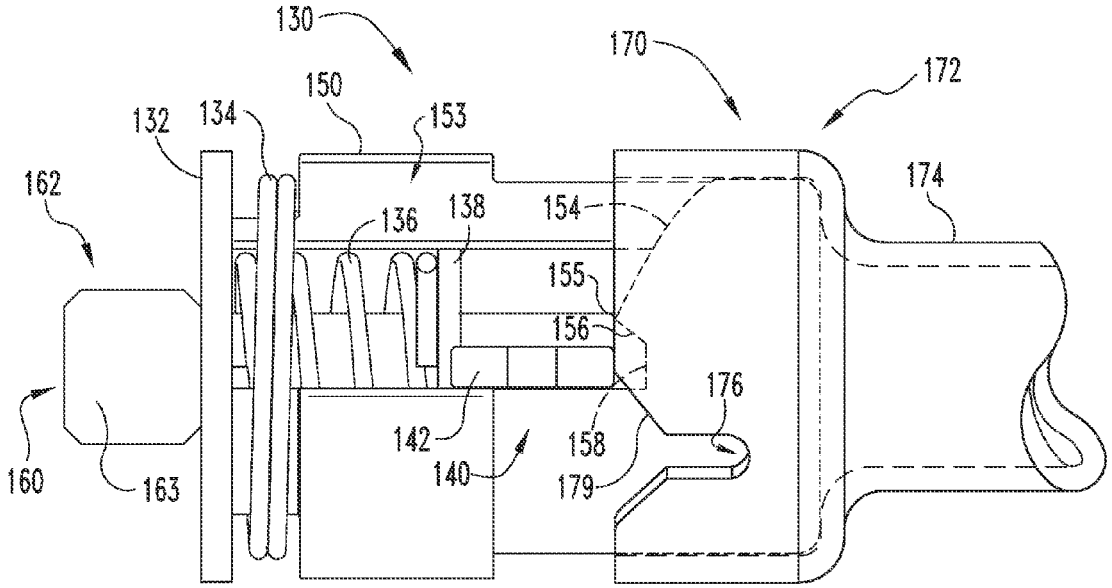
FIG. 6 is an elevational view of the illustrative lock control assembly in a transitional state.

With specific reference to FIG. 6, the proximal end surface 178 is positioned on the proximal side of the vertex 155, such that when the locking slide 140 is in contact with the proximal end surface 178, the rotational path of the cam 150 is clear. In other words, when the lock control assembly 130 is in a transitional unlocking state, the cam 150 is free to rotate without the secondary ramps 156 engaging the locking slide arms 142. When the cam 150 becomes free to rotate, the torsion spring 134 urges the cam 150 in the unlocking direction, and the distal edge 152 comes into alignment with the slide 140. Additionally, due to the fact that the crossbar 166 is seated in the cam slot 151, rotation of the cam 150 to the unlocking position also returns the turn piece 180 to the unlocking position. It is to be appreciated that, in the illustrated form, the unlocking direction is the same rotational direction by which the secondary ramp 156 extends from the vertex 155 to the ledge 158.

Figure 7:
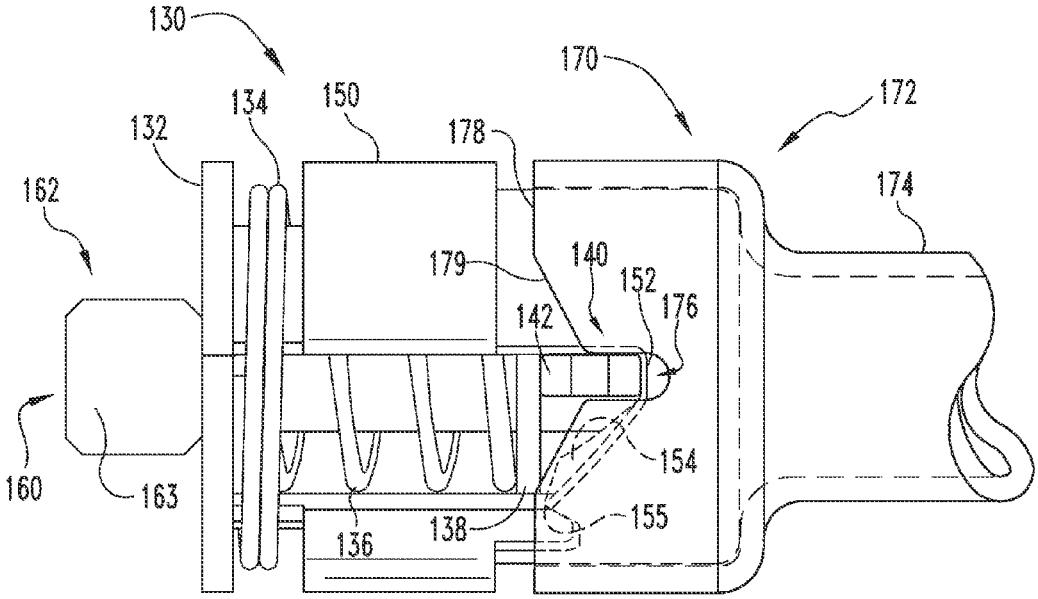
FIG. 7 is an elevational view of the illustrative lock control assembly in an unlocked state.

When the center spindle 170 is subsequently returned to the home position (e.g. under the force of an inner spring cage when the inner actuator is released), the compression spring 136 urges the slide 140 in the distal direction, and the arms 142 enter the center spindle slots 176. Should the cam 150 not be fully returned to the unlocking position, the force of the compression spring 136 will cause the arms 142 to engage the primary ramps 154 to return the cam 150 to the unlocking position. In either event, after the inner actuator is released, the locking slide arms 142 are again received within the center spindle slots 176, and the lock control assembly 130 is in the unlocked state (FIG. 7).

In the illustrated form, the center spindle 170 has two chamfers 179 on opposing sides of each slot 176, such that rotation of the center spindle 170 in either direction will cause the system 100 to automatically unlock in the manner described above. In order to prevent inadvertent unlocking, the torsion spring 134 may be selected to provide a biasing force which is sufficient to rotate the cam 150 when the rotational path of the cam 150 is clear, but is not great enough to rotate the cam 150 when the arms 142 are engaged with the secondary ramps 156. That is to say, the rotational biasing force of the torsion spring 134 may be less than the force required for the secondary ramps 156 to urge the slide 140 in the proximal direction against the force of the compression spring 136.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

a housing;

an outer spindle rotatably coupled to the housing;

a center spindle having a distal portion and a proximal portion, the distal portion including a stem configured for connection with a latch assembly, and the proximal portion including a cup comprising a slot and a chamfer extending from the slot in a proximal direction; and a lock control assembly comprising:

a cam received in the cup and including a primary ramp, a secondary ramp, and a vertex connecting the primary ramp to the secondary ramp, wherein the primary ramp extends from the vertex in a first rotational direction and a distal direction to a first terminus, wherein the secondary ramp extends from the vertex in a second rotational direction and the distal direction to a second terminus, and wherein the second terminus is positioned proximally of the first terminus;

a locking slide having a proximal locking position and a distal unlocking position, wherein the locking slide rotationally couples the outer spindle and the housing when in the locking position, and wherein the locking slide rotationally couples the outer spindle and the center spindle when in the unlocking position;

an axial biasing member urging the locking slide in the distal direction toward the unlocking position; and a rotational biasing member urging the cam in the second rotational direction;

wherein, with the locking slide in the locking position, a distal surface of the locking slide is aligned with the chamfer, such that the chamfer is operable to urge the locking slide in the proximal direction in response to rotation of the center spindle.

2. The system of claim 1, wherein the cup further comprises a proximal end surface, wherein the chamfer extends from the slot to the proximal end surface, and wherein the proximal end surface is positioned on a proximal side of the vertex.

3. The system of claim 1, wherein a distal end of the chamfer is positioned axially between the first terminus and the second terminus.

4. The system of claim 3, wherein the cam further comprises a proximal ledge extending from the secondary ramp in the second rotational direction, and wherein the cam has a first cam position in which at least a portion of the ledge is angularly aligned with the slot, is engaged with the locking slide, and retains the locking slide in the locking position against the urging of the axial biasing member.

5. The system of claim 4, wherein the locking slide further has a transitional unlocking position in which the locking slide is engaged with a proximal end surface of the cup;

wherein the rotational biasing member is configured to urge the cam to a second cam position when the locking slide is in the transitional unlocking position; and wherein, with the cam in the second cam position, the ledge is not angularly aligned with the slot.

6. The system of claim 5, wherein, with the cam in the second cam position, a portion of the primary ramp is angularly aligned with the slot.

7. The system of claim 5, wherein the cam further comprises a distal ledge extending from the primary ramp in the first rotational direction; and wherein, with the cam in the second cam position, at least a portion of the distal ledge is angularly aligned with the slot.

8. The system of claim 5, further comprising a plunger bar rotationally coupled with the cam, and a lock actuator operable to rotate the plunger bar.

9. The system of claim 8, further comprising a manual actuator and a lock cylinder, wherein the manual actuator is coupled to the outer spindle, wherein the lock cylinder is housed in the manual actuator and includes a selectively rotatable plug, and wherein the lock actuator comprises a key cam operable to rotate the plunger bar in response to rotation of the plug.

10. A system, comprising:

a housing configured for mounting on an unsecured side of a door, the housing including a first housing slot;

an outer spindle rotatably coupled to the housing and including a first outer spindle slot;

a center spindle including a cup and a stem, wherein the cup includes a first center spindle slot and a proximal end surface; and a lock control assembly having a locked state and an unlocked state, the lock control assembly comprising:

a locking slide including a first arm extending through the first outer spindle slot, the locking slide having a locked position in which the first arm is received in the first housing slot and an unlocked position in which the first arm is received in the first center spindle slot;

a cam including an opening defined in part by a first distal landing, a first proximal landing, a first ramp extending proximally from the first distal landing to a first vertex, and a second ramp extending proximally from the first proximal landing to the first vertex, wherein the cam has a locking position in which the first proximal landing is aligned with the first arm and an unlocking position in which the first distal landing is aligned with the first arm;

a compression spring configured to axially bias the locking slide distally toward the unlocked position; and a torsion spring configured to rotationally bias the cam toward the unlocking position;

wherein, in the locked state, the locking slide is in the locked position, the cam is in the locking position, and the first arm is in contact with the first proximal landing; and wherein, in the unlocked state, the locking slide is in the unlocked position, and the cam is in the unlocking position.

11. The system of claim 10, further comprising a spring anchor coupled to the outer spindle, wherein the compression spring is positioned between the spring anchor and the locking slide, and wherein the torsion spring couples the spring anchor and the cam.

12. The system of claim 10, wherein the outer spindle further includes including a second outer spindle slot, the cup further includes a second center spindle slot, and the locking slide further includes a second arm extending through the second outer spindle slot;

wherein, with the locking slide in the locked position, the second arm is received in a second housing slot;

wherein, with the locking slide in the unlocked position, the second arm is received in the second center spindle slot;

wherein the opening is further defined by a second distal landing aligned with the first distal landing, a second proximal landing aligned with the first proximal landing, a third ramp extending proximally from the second distal landing to a second vertex, and a fourth ramp extending proximally from the second proximal landing to the second vertex; and wherein, in the locked state, the second arm is in contact with the second proximal landing.

13. The system of claim 12, wherein, in the unlocked state, the first arm is in contact with the first distal landing and the second arm is in contact with the second distal landing.

14. The system of claim 10, wherein first proximal landing is positioned distally of the proximal end surface of the cup, wherein the cup further includes a chamfer connecting the proximal end surface and the first center spindle slot.

15. A lock control assembly for a locking assembly including an inner handle and an outer handle, the lock control assembly comprising:

a center spindle configured for connection with the inner handle, the center spindle comprising a stem and a cup, the cup including a proximal surface, a slot, and a tapered surface extending proximally from an edge of the slot to the proximal surface;

a substantially cylindrical cam rotatably seated in the cup, the cam including an opening defined in part by a cam surface including a primary ramp having a distal end positioned on a distal side of the tapered surface, a secondary ramp, a ledge axially aligned with the tapered surface and connected to a distal end of the secondary ramp, and a vertex connecting the primary ramp and the secondary ramp;

an axially movable locking element seated in the opening and extending radially out of the cam;

a rotational biasing member urging the cam in a first rotational direction; and an axial biasing member urging the locking element in a distal direction;

wherein the lock control assembly has an unlocking state in which the outer handle is operable to rotate the center spindle, a locking state in which the outer handle is not operable to rotate the center spindle, and a transitional state;

wherein, with the lock control assembly in the unlocking state, the cam is in an unlocking position, and the locking element is in a first position, extends through the slot, and rotationally couples the outer handle to the center spindle;

wherein, with the lock control assembly in the locking state, the center spindle is in a home position, the cam is in a locking position in which the ledge is angularly aligned with the slot, the locking element is in a second position in which a distal surface of the locking element is engaged with the ledge and is axially aligned with the tapered surface, and the outer handle is decoupled from the center spindle;

wherein the tapered surface is configured to urge the locking element from the second position to a third position in response to rotation of the center spindle from the home position to a rotated position; and wherein, with the lock control assembly in the transitional state, the locking element is in the third position, the center spindle is in the rotated position, the distal surface of the locking element is engaged with the proximal surface of the cup, and the rotational biasing member is operable to move the cam from the locking position toward the unlocking position.

16. The lock control assembly of claim 15, wherein the axial biasing member is operable to urge the locking element from the third position to the first position in response to rotation of the center spindle from the rotated position to the home position.

17. A system including the lock control assembly of claim 15, the system further comprising the outer handle and an outer spindle rotationally coupled to the outer handle, wherein the outer spindle includes an outer spindle slot angularly aligned with the slot of the center spindle;

wherein the locking element extends through the outer spindle slot; and wherein, with the lock control assembly in the unlocking state, the locking element in the first position extends through the outer spindle slot and the center spindle slot, thereby rotationally coupling the outer handle to the center spindle through the outer spindle.

18. The system of claim 17, further comprising a housing, wherein the outer spindle is rotatably mounted to the housing, and wherein the housing includes a housing slot; and wherein, with the lock control assembly in the locking state, the locking element extends through the outer spindle slot into the housing slot, thereby rotationally coupling the outer spindle to the housing.

* * * * *